US007941936B2

(12) United States Patent
Mangano

(10) Patent No.: US 7,941,936 B2
(45) Date of Patent: May 17, 2011

(54) GARMENT DRYING APPARATUS

(75) Inventor: Joy Mangano, St. James, NY (US)

(73) Assignee: Ingenious Designs LLC, Edgewood, NY (US)

( * ) Notice: Subject to any disclaimer, the term of this patent is extended or adjusted under 35 U.S.C. 154(b) by 219 days.

(21) Appl. No.: 11/802,673

(22) Filed: May 24, 2007

(65) Prior Publication Data

US 2008/0289210 A1 Nov. 27, 2008

(51) Int. Cl.
*F26B 7/00* (2006.01)

(52) U.S. Cl. ..... 34/235; 34/132; 34/202; 34/104; 34/624; 34/621; 223/91; 206/287; D23/403; D23/370; 68/5 C; 68/6; 219/400; 219/521

(58) Field of Classification Search ..... 34/235, 34/132, 202, 104, 624, 621; 68/5 C, 6; 219/400, 219/521; 454/222; D23/403, 370; 206/287; 223/91

See application file for complete search history.

(56) References Cited

U.S. PATENT DOCUMENTS 967,346 A * 8/1910 Dirkes ..... 454/222
1,833,631 A * 11/1931 Wilsey ..... 34/233
1,893,398 A * 1/1933 Chamberlin ..... 68/24
2,057,406 A * 10/1936 Willson ..... 248/411
2,114,776 A * 4/1938 Davis ..... 68/18 R
D115,502 S * 7/1939 Kohl ..... D3/293
D117,957 S * 12/1939 Novotny ..... D32/10
2,182,156 A * 12/1939 McCarty ..... 53/473
2,203,422 A * 6/1940 Strobridge ..... 34/527
2,206,148 A * 7/1940 Ayler ..... 69/23
2,301,803 A * 11/1942 Davis ..... 210/771
2,324,072 A * 7/1943 Frost ..... 206/287
2,353,374 A * 7/1944 Thompson ..... 211/170
2,353,741 A * 7/1944 Matthews et al. ..... 223/70
2,363,467 A * 11/1944 Strobridge ..... 34/552
2,443,557 A * 6/1948 Fitpold ..... 223/67
2,445,403 A * 7/1948 Mayerman ..... 34/622
2,463,218 A * 3/1949 Travis ..... 34/60
D153,556 S * 4/1949 Russell ..... D3/278
2,527,642 A * 10/1950 McWhorter ..... 223/88
2,571,918 A 10/1951 Meninger
2,626,689 A * 1/1953 Davis et al. ..... 206/287.1
2,645,033 A * 7/1953 Kling et al. ..... 34/82
2,701,921 A 2/1955 Strongson
2,704,896 A * 3/1955 Hopkins ..... 34/76
2,705,377 A * 4/1955 Koastandt ..... 34/665
2,728,996 A * 1/1956 Mason ..... 34/234
2,732,701 A * 1/1956 Smith ..... 68/20
2,751,734 A * 6/1956 Ratliff ..... 53/241

(Continued)

FOREIGN PATENT DOCUMENTS

CN 2256901 6/1997

(Continued)

*Primary Examiner* — Stephen M. Gravini
(74) *Attorney, Agent, or Firm* — Kenyon & Kenyon LLP

(57) ABSTRACT

A garment drying apparatus including upper and lower housings with an expandable and collapsible wall extending therebetween. The apparatus may include at least one support pole and/or bracket to support the upper housing to expand the wall. The upper and lower housings may include openings to slidably receive ends of the at least one support pole and/or bracket. A blower assembly can be located within the lower housing configured to circulate air through one or more vents, wherein when the wall is in an expanded position, the blower assembly circulates air through the one or more vents and into the chamber to dry and press the garment.

20 Claims, 4 Drawing Sheets

U.S. PATENT DOCUMENTS

| | | | | | |
|---|---|---|---|---|---|
| 2,831,268 | A | * | 4/1958 | Cox | 34/81 |
| 2,846,128 | A | * | 8/1958 | Fuller et al. | 223/91 |
| 2,850,810 | A | * | 9/1958 | Lyons III et al. | 34/665 |
| 2,856,700 | A | * | 10/1958 | Wales | 34/91 |
| 2,910,137 | A | * | 10/1959 | Victor | 8/141 |
| 2,941,308 | A | * | 6/1960 | Cobb et al. | 34/552 |
| 2,948,095 | A | * | 8/1960 | Nelson | 53/241 |
| 2,975,529 | A | * | 3/1961 | Weber | 34/622 |
| 3,022,580 | A | * | 2/1962 | Doty | 34/60 |
| 3,023,514 | A | * | 3/1962 | Gibson | 34/589 |
| 3,027,739 | A | * | 4/1962 | McCallum | 68/5 A |
| 3,059,563 | A | * | 10/1962 | Larson | 454/188 |
| D196,065 | S | * | 8/1963 | Lee | D32/10 |
| 3,103,112 | A | * | 9/1963 | Behrens et al. | 68/18 R |
| 3,106,831 | A | * | 10/1963 | Behrens | 68/12.08 |
| 3,160,482 | A | * | 12/1964 | Foote | 34/665 |
| 3,161,481 | A | * | 12/1964 | Edwards | 34/527 |
| 3,162,032 | A | * | 12/1964 | Behrens | 68/18 F |
| 3,210,862 | A | * | 10/1965 | Lycan | 34/527 |
| 3,214,032 | A | * | 10/1965 | Hightower | 211/99 |
| 3,220,117 | A | * | 11/1965 | Lycan | 34/527 |
| 3,248,800 | A | * | 5/1966 | Pierce, Jr. | 34/528 |
| 3,270,530 | A | * | 9/1966 | Czech | 68/18 R |
| 3,273,256 | A | * | 9/1966 | Behrens | 34/546 |
| 3,277,583 | A | * | 10/1966 | Mack | 34/58 |
| 3,280,477 | A | * | 10/1966 | Rawlins | 34/622 |
| 3,283,548 | A | * | 11/1966 | Czech | 68/12.08 |
| 3,302,305 | A | * | 2/1967 | Little | 34/665 |
| 3,315,772 | A | * | 4/1967 | Katz | 206/287.1 |
| 3,316,659 | A | * | 5/1967 | Lauck | 34/600 |
| 3,323,336 | A | * | 6/1967 | Johnson et al. | 68/18 R |
| 3,352,627 | A | * | 11/1967 | Indreland | 8/137 |
| 3,357,374 | A | * | 12/1967 | Smith et al. | 108/29 |
| 3,362,082 | A | * | 1/1968 | Hawkins | 34/527 |
| 3,401,052 | A | * | 9/1968 | Berger et al. | 427/242 |
| 3,402,576 | A | * | 9/1968 | Krupsky | 68/4 |
| 3,417,481 | A | * | 12/1968 | Rumsey, Jr. | 34/72 |
| D213,139 | S | * | 1/1969 | Brendgod | D32/10 |
| 3,432,939 | A | * | 3/1969 | Eichholz | 34/622 |
| 3,436,934 | A | * | 4/1969 | Stilwell, Jr. | 68/140 |
| 3,475,828 | A | * | 11/1969 | Moscowitz et al. | 34/443 |
| 3,487,557 | A | * | 1/1970 | Linstead | 34/619 |
| 3,516,174 | A | * | 6/1970 | Behrens | 34/534 |
| 3,529,358 | A | * | 9/1970 | Robinson | 34/494 |
| 3,576,079 | A | * | 4/1971 | Hauser | 34/542 |
| 3,577,650 | A | * | 5/1971 | Brahm | 34/622 |
| 3,594,917 | A | * | 7/1971 | Montgomery | 34/621 |
| 3,601,292 | A | | 8/1971 | Bliss | |
| 3,605,272 | A | * | 9/1971 | Boucher | 4/261 |
| 3,611,757 | A | * | 10/1971 | Hills | 8/5 B |
| 3,614,388 | A | * | 10/1971 | Robinson | 219/400 |
| 3,672,188 | A | * | 6/1972 | Geschka et al. | 68/12.15 |
| 3,738,451 | A | * | 6/1973 | Kirkpatrick | 182/155 |
| 3,739,492 | A | * | 6/1973 | Brooks | 34/622 |
| 3,752,373 | A | * | 8/1973 | Smith | 223/51 |
| 3,799,416 | A | * | 3/1974 | Schmaltz | 294/142 |
| 3,805,561 | A | * | 4/1974 | Bullock | 68/5 C |
| 3,811,198 | A | * | 5/1974 | Baltes | 34/466 |
| 3,835,552 | A | * | 9/1974 | Lord | 4/621 |
| 3,849,815 | A | * | 11/1974 | Frauendorf | 8/149.1 |
| 3,869,815 | A | * | 3/1975 | Bullock | 38/77.6 |
| 3,905,125 | A | * | 9/1975 | Hubner | 34/622 |
| 3,929,224 | A | * | 12/1975 | Smith, Jr. | 206/287 |
| 3,952,847 | A | * | 4/1976 | Via | 383/106 |
| 4,032,294 | A | * | 6/1977 | Thompson et al. | 8/116.4 |
| 4,035,927 | A | * | 7/1977 | Spiegel | 34/622 |
| 4,070,876 | A | * | 1/1978 | Thompson et al. | 68/3 R |
| D256,048 | S | * | 7/1980 | Brown | D23/403 |
| 4,287,674 | A | * | 9/1981 | Selivanov et al. | 34/201 |
| 4,341,517 | A | * | 7/1982 | Gittins-Thomas | 432/141 |
| D268,283 | S | * | 3/1983 | Hicks | D23/370 |
| 4,406,071 | A | * | 9/1983 | Buchanan | 34/91 |
| 4,429,928 | A | * | 2/1984 | Sullivan | 312/31 |
| 4,471,537 | A | * | 9/1984 | Meda | 34/77 |
| 4,484,362 | A | * | 11/1984 | Asher | 2/69 |
| 4,493,160 | A | * | 1/1985 | Brembilla et al. | 38/14 |
| 4,550,579 | A | * | 11/1985 | Clifford | 68/5 C |
| 4,562,627 | A | * | 1/1986 | Milligan | 26/18.5 |
| 4,572,364 | A | * | 2/1986 | Jordan | 206/287 |
| 4,578,881 | A | * | 4/1986 | Karlsson | 34/619 |
| 4,585,120 | A | * | 4/1986 | Jaffe | 206/279 |
| 4,625,432 | A | * | 12/1986 | Baltes | 34/621 |
| 4,653,295 | A | * | 3/1987 | Clifford | 68/205 R |
| 4,658,511 | A | * | 4/1987 | Mahlich et al. | 34/97 |
| 4,677,764 | A | * | 7/1987 | Cerny | 34/195 |
| 4,682,424 | A | * | 7/1987 | Irving | 34/621 |
| 4,738,125 | A | * | 4/1988 | Clifford | 68/205 R |
| 4,761,896 | A | * | 8/1988 | Miyata | 34/77 |
| 4,828,571 | A | * | 5/1989 | Pensa et al. | 8/492 |
| 4,845,790 | A | * | 7/1989 | Brasington | 8/150 |
| 4,854,431 | A | * | 8/1989 | Pulichino et al. | 190/108 |
| 4,858,867 | A | * | 8/1989 | King | 248/214 |
| 4,866,859 | A | * | 9/1989 | Kopelman | 34/526 |
| 4,869,408 | A | * | 9/1989 | Lutz | 224/417 |
| 4,916,439 | A | * | 4/1990 | Estes et al. | 340/679 |
| D312,899 | S | | 12/1990 | Faulkner | |
| 5,094,020 | A | * | 3/1992 | Wingfield et al. | 38/1 A |
| 5,152,077 | A | * | 10/1992 | Liang | 34/77 |
| D332,329 | S | * | 1/1993 | Hood et al. | D32/8 |
| RE34,474 | E | * | 12/1993 | Lutz | 224/417 |
| 5,323,897 | A | * | 6/1994 | Sperber | 206/287 |
| 5,337,905 | A | * | 8/1994 | Gast | 211/85.3 |
| 5,351,417 | A | * | 10/1994 | Rubin | 34/90 |
| 5,352,006 | A | * | 10/1994 | Ocuin | 294/142 |
| 5,359,786 | A | * | 11/1994 | Vierling | 34/92 |
| 5,528,840 | A | * | 6/1996 | Pajak et al. | 34/622 |
| 5,528,912 | A | * | 6/1996 | Weber | 68/6 |
| 5,548,100 | A | * | 8/1996 | Miller | 219/521 |
| 5,568,691 | A | * | 10/1996 | Rubin | 34/98 |
| 5,642,572 | A | * | 7/1997 | Manning | 34/621 |
| 5,713,139 | A | * | 2/1998 | Briggs | 34/602 |
| 5,730,006 | A | * | 3/1998 | Conley | 68/6 |
| RE35,834 | E | * | 7/1998 | Miller | 219/521 |
| 5,776,378 | A | * | 7/1998 | Knight | 261/30 |
| 5,815,961 | A | * | 10/1998 | Estes et al. | 38/14 |
| 5,819,433 | A | * | 10/1998 | Crooks | 34/104 |
| 5,819,437 | A | * | 10/1998 | Briggs | 34/604 |
| 5,829,162 | A | * | 11/1998 | Pace | 34/202 |
| 5,930,915 | A | * | 8/1999 | Dhaemers | 34/511 |
| 5,970,626 | A | * | 10/1999 | Schmidt et al. | 34/631 |
| 5,996,249 | A | * | 12/1999 | Manning | 34/621 |
| 6,005,227 | A | * | 12/1999 | Pappas | 219/400 |
| 6,049,931 | A | * | 4/2000 | McClain et al. | 8/159 |
| 6,088,863 | A | * | 7/2000 | McClain et al. | 8/159 |
| 6,098,430 | A | * | 8/2000 | McClain et al. | 68/18 R |
| 6,122,941 | A | * | 9/2000 | McClain et al. | 68/18 R |
| 6,129,879 | A | * | 10/2000 | Bersted et al. | 264/211.14 |
| 6,134,806 | A | * | 10/2000 | Dhaemers | 34/404 |
| 6,189,346 | B1 | * | 2/2001 | Chen et al. | 68/5 R |
| 6,263,591 | B1 | * | 7/2001 | La Porte | 34/622 |
| 6,314,601 | B1 | * | 11/2001 | McClain et al. | 8/158 |
| 6,412,312 | B1 | * | 7/2002 | McClain et al. | 68/18 C |
| 6,455,817 | B1 | * | 9/2002 | Guzzi et al. | 219/400 |
| 6,457,257 | B1 | * | 10/2002 | Hughes | 34/218 |
| D466,657 | S | | 12/2002 | Van Hauwermeiren et al. | |
| 6,691,536 | B2 | * | 2/2004 | Severns et al. | 68/12.27 |
| 6,708,819 | B1 | * | 3/2004 | Lee | 206/287.1 |
| 6,745,496 | B2 | * | 6/2004 | Cassella | 34/621 |
| 6,757,986 | B2 | | 7/2004 | Miller et al. | |
| 6,796,053 | B2 | * | 9/2004 | Lurie | 34/104 |
| 6,802,137 | B1 | * | 10/2004 | Gray | 34/340 |
| 6,829,842 | B2 | * | 12/2004 | Zuccaro | 34/235 |
| 6,840,068 | B2 | | 1/2005 | Pasin et al. | |
| 6,849,094 | B1 | * | 2/2005 | North | 8/149.1 |
| 6,868,621 | B1 | * | 3/2005 | Grimm et al. | 34/92 |
| 6,898,951 | B2 | * | 5/2005 | Severns et al. | 68/5 C |
| 6,922,911 | B2 | * | 8/2005 | Lam | 34/239 |
| 7,084,099 | B2 | * | 8/2006 | Radomyselski et al. | 510/285 |
| 7,140,121 | B2 | * | 11/2006 | Casella et al. | 34/201 |
| 7,171,761 | B1 | * | 2/2007 | Hunts | 34/91 |
| 7,207,197 | B2 | * | 4/2007 | North | 68/5 C |
| 7,207,426 | B2 | * | 4/2007 | Godshaw et al. | 190/1 |
| D546,006 | S | * | 7/2007 | Stroud et al. | D32/8 |
| 7,241,728 | B2 | * | 7/2007 | Radomyselski et al. | 510/285 |
| 7,252,688 | B2 | * | 8/2007 | Tashiro et al. | 8/149.1 |
| D552,808 | S | * | 10/2007 | Garman et al. | D32/8 |
| 7,275,400 | B2 | * | 10/2007 | Severns et al. | 68/18 F |

| | | | | |
|---|---|---|---|---|
| 7,444,840 | B2 * | 11/2008 | Jackson et al. | 68/5 C |
| D584,866 | S * | 1/2009 | Mangano | D32/8 |
| D587,012 | S * | 2/2009 | Webb | D3/299 |
| 7,665,227 | B2 * | 2/2010 | Wright et al. | 34/339 |
| 7,727,289 | B2 * | 6/2010 | Frazee et al. | 8/550 |
| 7,735,345 | B2 * | 6/2010 | Wright et al. | 68/13 R |
| 7,763,083 | B2 * | 7/2010 | Kimball et al. | 8/550 |
| 7,776,108 | B2 * | 8/2010 | Shah et al. | 8/550 |
| 7,780,744 | B2 * | 8/2010 | Shah et al. | 8/550 |
| 2002/0133886 | A1 * | 9/2002 | Severns et al. | 8/142 |
| 2002/0133969 | A1 * | 9/2002 | Cassella | 34/201 |
| 2003/0070238 | A1 * | 4/2003 | Radomyselski et al. | 8/137 |
| 2004/0068888 | A1 * | 4/2004 | Lurie | 34/90 |
| 2004/0129032 | A1 * | 7/2004 | Severns et al. | 68/5 C |
| 2005/0050644 | A1 * | 3/2005 | Severns et al. | 8/115.51 |
| 2005/0050756 | A1 * | 3/2005 | Casella | 34/218 |
| 2005/0092032 | A1 * | 5/2005 | North | 68/3 R |
| 2005/0115004 | A1 * | 6/2005 | Tashiro et al. | 8/102 |
| 2005/0120757 | A1 | 6/2005 | Jackson | |
| 2005/0183208 | A1 * | 8/2005 | Scheper et al. | 8/142 |
| 2006/0137211 | A1 * | 6/2006 | Casella et al. | 34/231 |
| 2006/0266603 | A1 * | 11/2006 | Godshaw et al. | 190/108 |
| 2006/0288499 | A1 * | 12/2006 | Kimball et al. | 8/550 |
| 2007/0028479 | A1 * | 2/2007 | Hunts | 34/202 |
| 2007/0151041 | A1 * | 7/2007 | McAllister et al. | 8/149.2 |
| 2007/0151310 | A1 * | 7/2007 | Wright et al. | 68/3 R |
| 2007/0151311 | A1 * | 7/2007 | McAllister et al. | 68/3 R |
| 2007/0151312 | A1 * | 7/2007 | Bruce et al. | 68/3 R |
| 2008/0147026 | A1 * | 6/2008 | Qin et al. | 604/358 |
| 2008/0289210 | A1 * | 11/2008 | Mangano | 34/104 |
| 2008/0307587 | A1 * | 12/2008 | Shah et al. | 8/441 |
| 2009/0019647 | A1 * | 1/2009 | Frazee et al. | 8/553 |
| 2009/0052808 | A1 * | 2/2009 | Pham et al. | 383/23 |
| 2009/0188952 | A1 * | 7/2009 | Boyd | 223/86 |
| 2009/0271933 | A1 * | 11/2009 | Shah et al. | 8/562 |
| 2010/0018262 | A1 * | 1/2010 | Beihoff et al. | 68/5 |
| 2010/0154146 | A1 * | 6/2010 | Shah et al. | 8/552 |
| 2010/0186176 | A1 * | 7/2010 | Wright et al. | 8/137 |
| 2010/0251777 | A1 * | 10/2010 | Komoto et al. | 68/20 |
| 2010/0281924 | A1 * | 11/2010 | Tobi et al. | 68/19 |
| 2010/0294003 | A1 * | 11/2010 | Tobi et al. | 68/12.01 |
| 2010/0300154 | A1 * | 12/2010 | Nakamura et al. | 68/13 R |
| 2011/0016928 | A1 * | 1/2011 | Beihoff et al. | 68/19 |

FOREIGN PATENT DOCUMENTS

| | | | | |
|---|---|---|---|---|
| DE | 3507757 | A1 * | | 9/1986 |
| DE | 3639314 | A1 * | | 5/1988 |
| DE | 10128939 | A1 * | | 1/2003 |
| DE | 10223195 | | | 12/2003 |
| FR | 1525253 | | | 9/1968 |
| FR | 2298636 | | | 8/1976 |
| JP | 49-102372 | | | 9/1974 |
| JP | 52-109659 | | | 8/1977 |
| JP | 55-33158 | | | 3/1980 |
| JP | 02021899 | A | * | 1/1990 |
| JP | 03264092 | A | * | 11/1991 |
| JP | 05237293 | A | * | 9/1993 |
| JP | 09285695 | A | * | 11/1997 |
| JP | 2004194942 | A | * | 7/2004 |
| JP | 2006149932 | A | * | 6/2006 |
| JP | 2008289886 | A | * | 12/2008 |
| WO | WO 8900622 | A1 | * | 1/1989 |
| WO | WO 9854392 | A1 | * | 12/1998 |

* cited by examiner

GARMENT DRYING APPARATUS

TECHNICAL FIELD

The present invention generally relates to a garment drying apparatus.

BACKGROUND

The present invention generally relates to a garment drying apparatus which may be used in homes, apartments, hotels, motels, etc.

Washing machines may, in some instances, shrink and/or damage "drip-dry" or "permanent press" garments. Therefore, it may be necessary to wash these garments by hand. These garments may then be dried via exposure to the atmosphere using various methods (e.g., hanging garments over towel bars, shower curtain rods, clotheslines, etc.). However, frequently, there is not adequate room to dry the garments and/or the process itself may take too much time.

For these reasons, there is a need for a garment drying apparatus, which dries garments quickly, and is especially suitable for use in the home and/or during travel. Such an apparatus may be suitable for easy storage in the home, for use as an extra item carried by travelers, and/or as an extra appliance offered for use by a hotel or motel.

It is therefore a primary object of this invention to provide a new garment drying apparatus. Another object of this invention is to provide a garment drying apparatus especially suited for use in quickly drying a limited number of garments. Still another object of this invention is to provide an improved garment drying apparatus which may be collapsed to a compact configuration when not in use, making it easy to store and/or transport.

BRIEF DESCRIPTION

The present invention generally relates to a garment drying apparatus.

Embodiments of the present invention may include at least one support pole, an upper housing including at least one opening to slidably receive an end of the at least one support pole, and a lower housing including at least one opening for receiving the other end of the support pole. An expandable and collapsible wall can interconnect the housings to form a chamber in an expanded position for receiving a garment therein. The wall may have a sealing member to selectively open and close the chamber. A blower assembly may be located within the lower housing to circulate air through one or more vents, wherein when the wall is in the expanded position, the blower assembly circulates air through the one or more vents and into the chamber to dry and press the garment.

Other embodiments of the present invention may include at least one support bracket configured for mounting on a door, an upper housing including at least one opening to slidably receive an end of the at least one bracket therein, and a lower housing. An expandable and collapsible wall can interconnect the housings to form a chamber in an expanded position for receiving a garment therein. The wall may have a sealing member to selectively open and close the chamber. A blower assembly may be located within the lower housing to circulate air through one or more vents, wherein when the wall is in the expanded position, the blower assembly circulates air through the one or more vents and into the chamber to dry and press the garment.

The invention may be embodied by numerous other apparatuses, methods, and systems comprising features of multiple embodiments. The description provided herein, when taken in conjunction with the annexed drawings, discloses examples of the invention. Other embodiments, which incorporate some or all steps as taught herein, are also possible.

BRIEF DESCRIPTION OF THE DRAWINGS

Referring to the drawings, which form a part of this disclosure.

DETAILED DESCRIPTION

Figure 1:
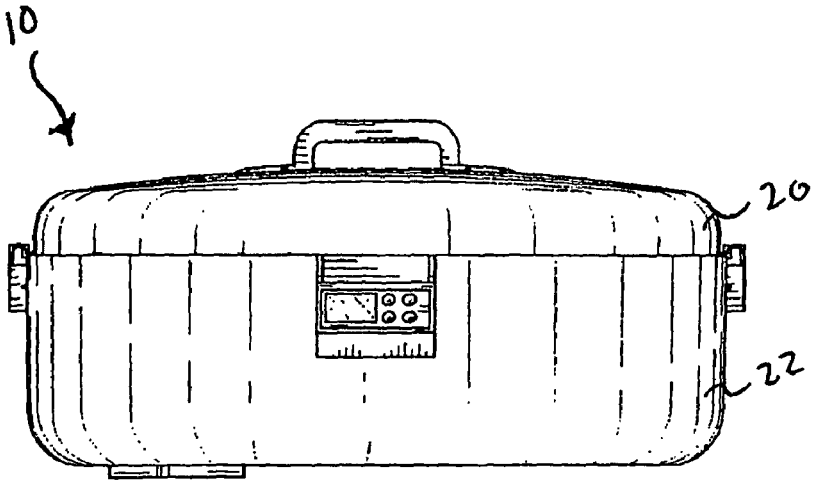
FIG. 1 is a front view of a garment drying apparatus in a closed position as may be employed in accordance with certain embodiments of the present invention.
Figure 2:
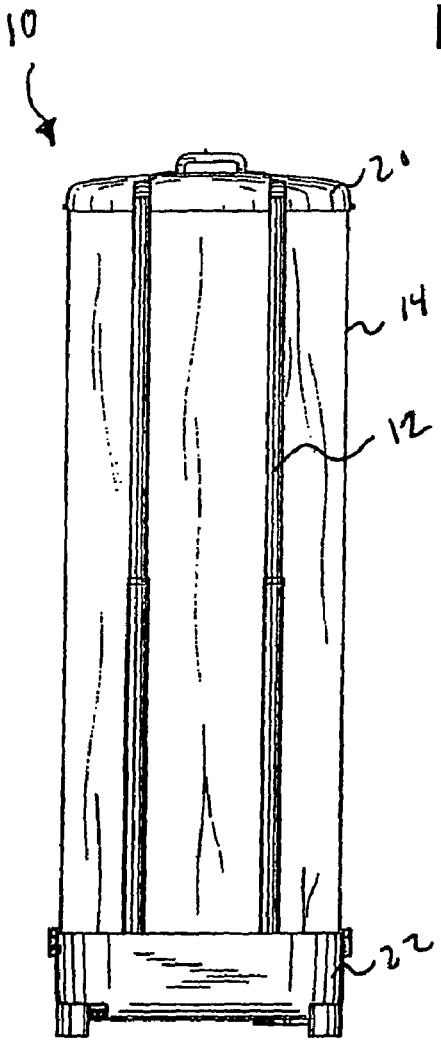
FIG. 2 is a rear view of the apparatus of FIG. 1 in an expanded position.
Figure 3:
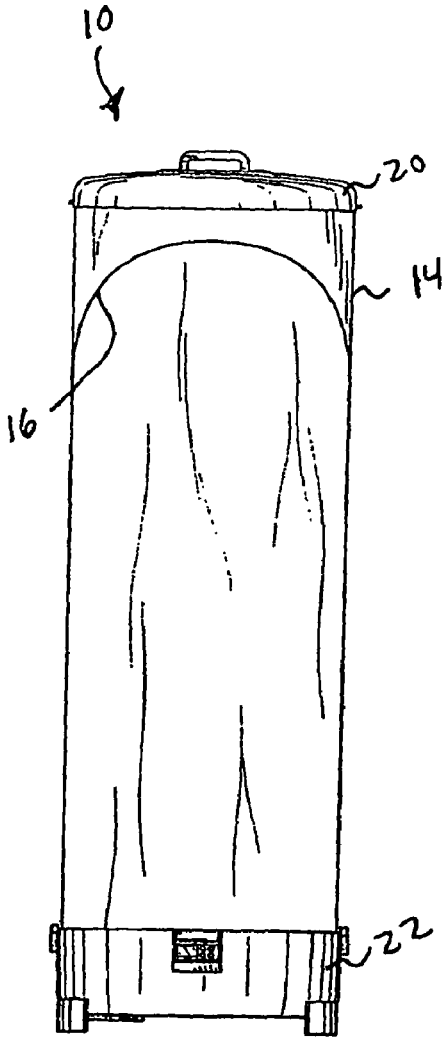
FIG. 3 is a front view of the apparatus of FIG. 2.

The present invention generally relates to garment drying. Referring initially to FIG. 1, a garment drying apparatus 10 as may be employed with certain embodiments of the present invention is shown in the closed position. Turning to FIGS. 2-3, these figures show the apparatus of FIG. 1 in an expanded position.

As can be seen in FIGS. 1-3, the garment drying apparatus 10 includes upper and lower housings 20, 22, a pair of support poles 12 extending therebetween, and an expandable and collapsible wall 14 interconnecting the housings 20, 22 to form a chamber for receiving a garment therein.

FIG. 2 illustrates the pair of support poles 12. These support poles 12 may be telescoping and/or otherwise adjustable. Although a pair of support poles 12 are shown in this example, any number of support poles 12 may be used.

FIGS. 2-3 illustrate a wall 14. This wall 14, which may be expandable and collapsible, interconnects the housings 20, 22 to form a chamber for receiving the garment therein. The wall 14 may have a sealing member 16 to selectively open and close the chamber. For instance, in the embodiments shown, the sealing member 16 is a zipper; however, other arrangements may be used. Also in the example shown, the wall 14 may be connected to the housings 20, 22 via stitching. Although stitching is used in this example, any suitable method may be used including, but not limited to, buttons.

Figure 4A:
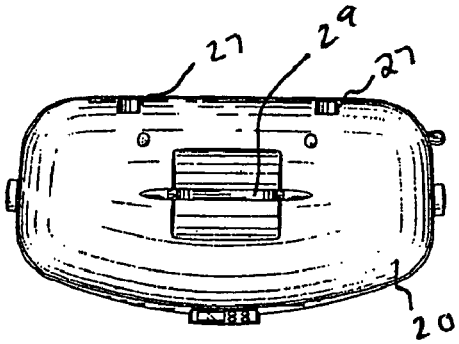
FIGS. 4*a-c* are plan views of the apparatus of FIG. 1
Figure 4B:
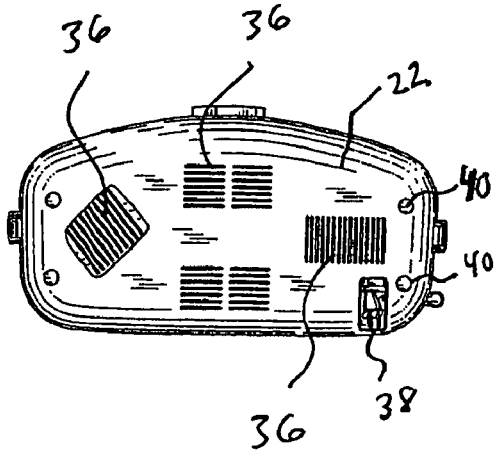
Figure 4C:
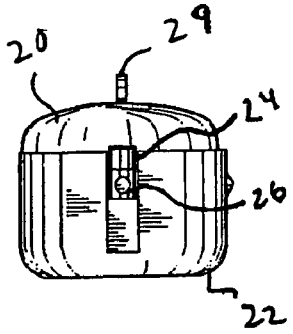
Figure 4D:
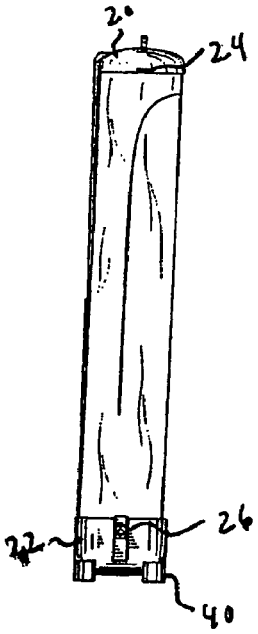
FIG. 4*d* is a side view of the apparatus of FIG. 1 in an expanded position.

Turning to FIGS. 4*a-d*, these figures illustrate various views of the upper and lower housings 20, 22. For example, as seen in FIGS. 4*c-d*, one of the housings 20, 22 may have a flange 24, while the other housing has a fastener 26 for mechanically affixing the housings 20, 22 together in the closed position.

Figure 5:
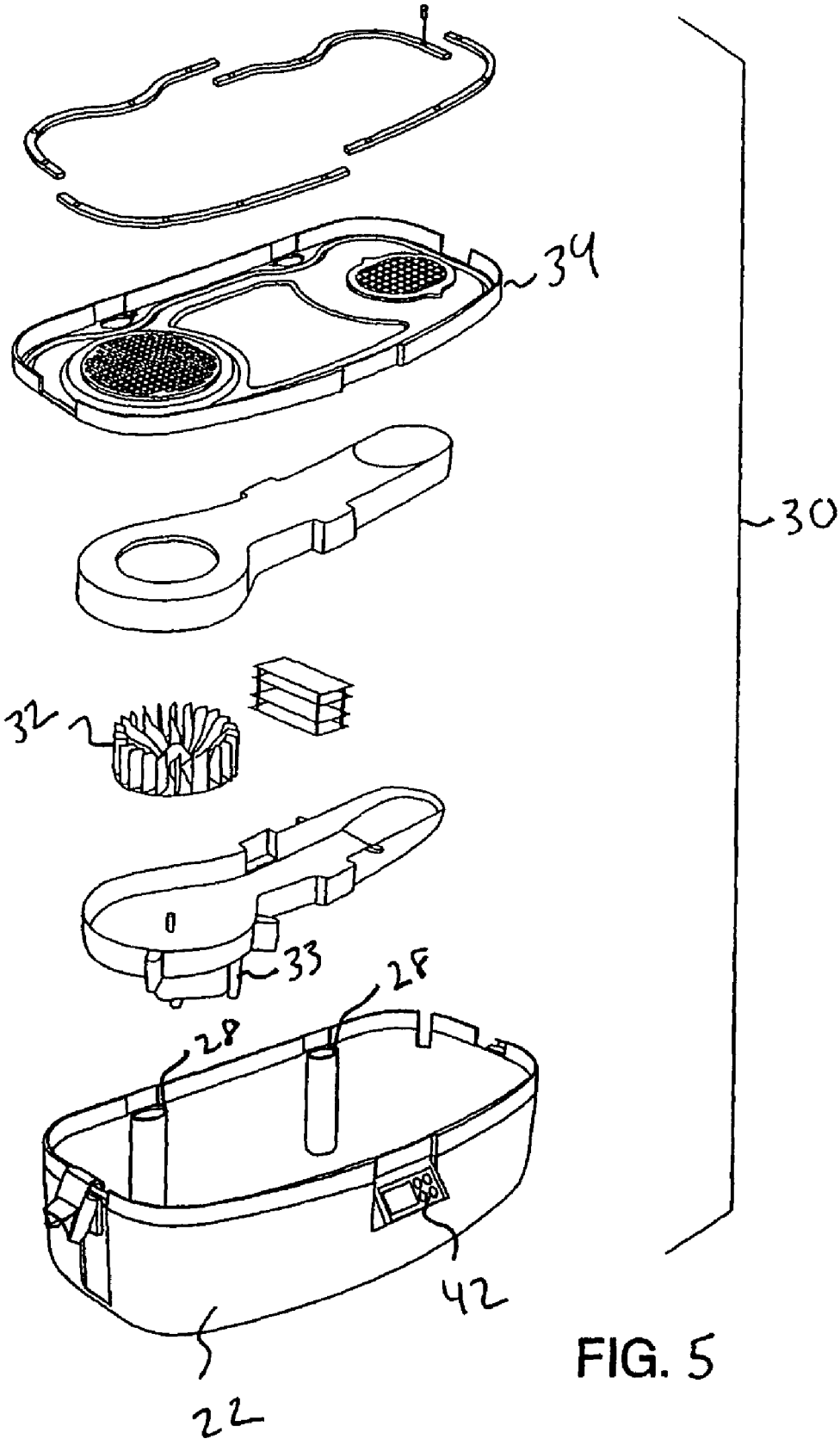
FIG. 5 is an exploded view of a blower assembly as may be employed with certain embodiments of the present invention.

The upper and lower housings 20, 22 may also include openings to slidably receive respective ends of the support poles 12 therein. For example, FIG. 4*a* illustrates openings 27 on the upper housing 20, while FIG. 5 illustrates openings 28 on the lower housing 22. Although in the examples shown, a pair of support poles 12 are used, any number of support poles 12 may be used including a single pole.

Detent mechanisms, as are well known in the art, may be located on the upper and lower housings 20, 22 configured to temporarily fix the support poles 12 with respect to the housings 20, 22. Detent mechanisms may also be placed on the support poles 12 themselves for temporarily fixing the support poles 12 with respect to the housings 20, 22.

As seen in FIGS. 4*a, c*, the upper housing 20 may be provided with a handle 29 to assist with, for instance, carrying the apparatus in the closed position and moving the apparatus in the open position. The upper housing 20 may also be provided with a bracket, such as on an inner surface thereof, configured for supporting a garment hanger within the chamber formed by the wall 14.

Turning now to FIGS. 4*b, d*, it can be appreciated by certain embodiments of the present invention that the lower housing 22 may also include a retractable power cord 38 electrically connected to the blower assembly 30 (FIG. 5). In addition, to facilitate air flow, the lower housing 22 can have feet 40 for elevating the blower assembly 30 (FIG. 5). Moreover, the feet may also assist in providing an inclined surface on the lower housing 22. For example, a portion of the lower housing 22 may be inclined to facilitate the removal of water (e.g., water that collects when drying a garment).

FIG. 5 is an exploded view of the blower assembly 30 of the lower housing. The blower assembly 30 may be used for circulating air which dries and presses the garments. Any electromechanical blower assembly 30 as is well known in the art may be used. For example, the blower assembly 30 may generally include a fan 32, a motor assembly 33, and one or more vents 34 for circulating air therethrough. Accordingly, when the wall is an expanded position in some embodiments, the blower assembly can draw air in through vents 36 (FIG. 4*b*) and exhaust air out through vents 34 (FIG. 5) to circulate air through the chamber to dry and press the garment received therein. This venting arrangement is merely exemplary and other arrangements may be used.

FIG. 5 also shows that the lower housing 22 may be provided with a control assembly 42. Any control assembly 42 as is well known in the art may be used. For example, the control assembly 42 may include air flow and temperature control switches.

Figure 6:
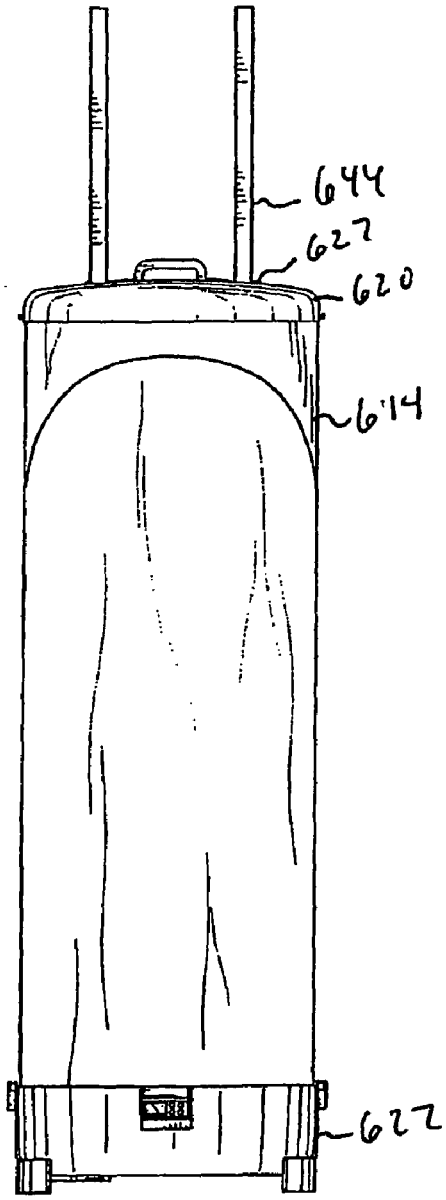
FIGS. 6-7 are front and side views of a garment drying apparatus in an expanded position as may be employed in accordance with other embodiments of the present invention.
Figure 7:
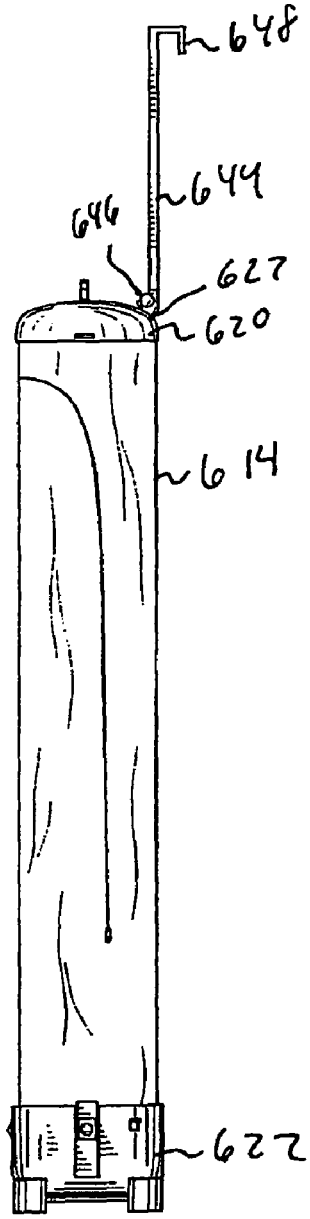

FIGS. 6-7 show another embodiment of the garment drying apparatus as may be employed in accordance with certain embodiments of the present invention. This embodiment is identical to that of the one described with reference to FIGS. 1-5 herein above, except support brackets 644 may be used to expand the wall 614. For example, support brackets 644 may be connected with apertures 627 located on the upper housing 620. The support brackets 644 may be hinged 646 and/or may have at least one notch (not shown) configured to cooperate with a detent mechanism of the upper housing 620. Any number of support brackets 644 may be used including a single support bracket. The support brackets 644 may have an L-shaped flange 648 on one end configured for mounting on an object such as a door or the like. It is contemplated by embodiments of the present invention that the support brackets 644 may be mounted on any suitable object that enables expansion of the wall 614 a suitable distance between the upper and lower housings 620, 622.

While various embodiments have been described, other embodiments are possible. It should be understood that the foregoing descriptions of various examples of the garment drying apparatus are not intended to be limiting, and any number of modifications, combinations, and alternatives of the examples may be employed.

The examples described herein are merely illustrative, as numerous other embodiments may be implemented without departing from the spirit and scope of the exemplary embodiments of the present invention. Moreover, while certain features of the invention may be shown on only certain embodiments or configurations, these features may be exchanged, added, and removed from and between the various embodiments or configurations while remaining within the scope of the invention. Likewise, methods described and disclosed may also be performed in various sequences, with some or all of the disclosed steps being performed in a different order than described while still remaining within the spirit and scope of the present invention.

What is claimed is:

1. A garment drying and pressing apparatus, comprising:

at least one support pole;

an upper housing including an opening for receiving an end of the at least one support pole therein;

a lower housing including at least one aperture for receiving the other end of the at least one support pole therein;

an expandable and collapsible wall interconnecting an upper surface of the lower housing and a bottom surface of the upper housing to form a chamber in an expanded position for receiving one or more garments therein, the wall having a sealing member to selectively open and close the chamber; and a blower assembly located within the lower housing configured to circulate air through one or more vents, wherein when the wall is in the expanded position, the blower assembly circulates air through the one or more vents and into the chamber to dry and press the one or more garments, and wherein the at least one support pole extends outside of the chamber and between the housings during drying and pressing of the one or more garments.

2. The apparatus of claim 1 further comprising: a retractable power cord electrically connected to the blower assembly.

3. The apparatus of claim 1 further comprising: one or more detent mechanisms located on the upper housing configured to temporarily fix the at least one support pole with respect to the upper housing.

4. The apparatus of claim 1 further comprising: at least one detent mechanism located on the lower housing configured to temporarily fix the at least one support pole with respect to the lower housing.

5. The apparatus of claim 1 wherein the at least one support pole is adjustable.

6. The apparatus of claim 1 wherein one of the upper and lower housings has a flange and the other housing has a fastener for mechanically affixing the housings when the wall is in a contracted position.

7. The apparatus of claim 1 wherein the lower housing has at least one foot for elevating the blower assembly.

8. The apparatus of claim 1 wherein the wall is interconnected to the housings via stitching.

9. The apparatus of claim 1 wherein the upper housing has a support member configured for supporting a garment hanger.

10. A garment drying and pressing apparatus, comprising:

at least one support bracket having an end configured for mounting on a door;

an upper housing including at least one opening to slidably receive an end of the at least one support bracket;

a lower housing;

an expandable and collapsible wall interconnecting the upper and lower housings to form a chamber in an expanded position for receiving one or more garments therein, the wall having a sealing member to selectively open and close the chamber; and an electromechanical blower assembly located within the lower housing that circulates air through one or more vents, wherein when the wall is in the expanded position, the blower assembly circulates air through the one or more vents and into the chamber to dry and press the one or more garments.

11. The apparatus of claim 10 wherein the at least one support bracket is hinged.

12. The apparatus of claim 10 wherein the at least one support bracket has at least one notch configured to cooperate with a detent mechanism located within the upper housing.

13. The apparatus of claim 10 further comprising: a retractable power cord electrically connected to the blower assembly.

14. The apparatus of claim 10 further comprising: at least one detent mechanism located on the upper housing configured to temporarily fix the at least one support bracket with respect to the upper housing.

15. The apparatus of claim 10 wherein one of the upper and lower housings has a flange and the other housing has a fastener for mechanically affixing the housings when the wall is in a contracted position.

16. The apparatus of claim 10 wherein the lower housing has at least one foot for elevating the blower assembly.

17. The apparatus of claim 10 wherein the wall is interconnected to the housings via stitching.

18. The apparatus of claim 10 wherein upper housing has a support member configured for supporting a garment hanger.

19. The apparatus of claim 1 wherein a lower edge of the wall is connected to the upper surface of the lower housing and an upper edge of the wall is connected to the bottom surface of the upper housing.

20. The apparatus of claim 10 wherein the bracket is U-shaped such that it can be directly mounted on the top edge of the door.

* * * * *